United States Patent [19]

Gubri

[11] 4,428,152

[45] Jan. 31, 1984

[54] SWINGING DOORS FOR SHELTERS AND TO SHELTERS EQUIPPED WITH SUCH DOORS

[75] Inventor: Leon Gubri, Neuilly-sur-Seine, France

[73] Assignee: Establissements L. Gubri, Deschanel, France

[21] Appl. No.: 310,843

[22] Filed: Oct. 13, 1981

[30] Foreign Application Priority Data

Oct. 14, 1980 [FR] France ..... 80 21973

[51] Int. Cl.[3] ..... E06B 11/00

[52] U.S. Cl. ..... 49/131; 49/33

[58] Field of Search ..... 49/33, 37, 131

[56] References Cited

U.S. PATENT DOCUMENTS

| | | | |
|---|---|---|---|
| 1,524,956 | 2/1925 | Strauss | 49/37 X |
| 2,547,488 | 4/1951 | Potts | 49/37 |
| 2,837,780 | 6/1958 | Younger | 49/131 X |

FOREIGN PATENT DOCUMENTS

| | | | |
|---|---|---|---|
| 2402759 | 4/1979 | France | 49/33 |

*Primary Examiner*—Kenneth Downey

*Attorney, Agent, or Firm*—Larson and Taylor

[57] ABSTRACT

An underground shelter (1, 2, 3) for aircraft is equipped with a vertical door (5) mounted for swinging about a lower horizontal axis (X), the swinging movements of this door being controlled by means of external jacks (13), with axes inclined with respect to the horizontal, adapted to be retracted into pits (16) which are closable when the door is closed.

9 Claims, 8 Drawing Figures

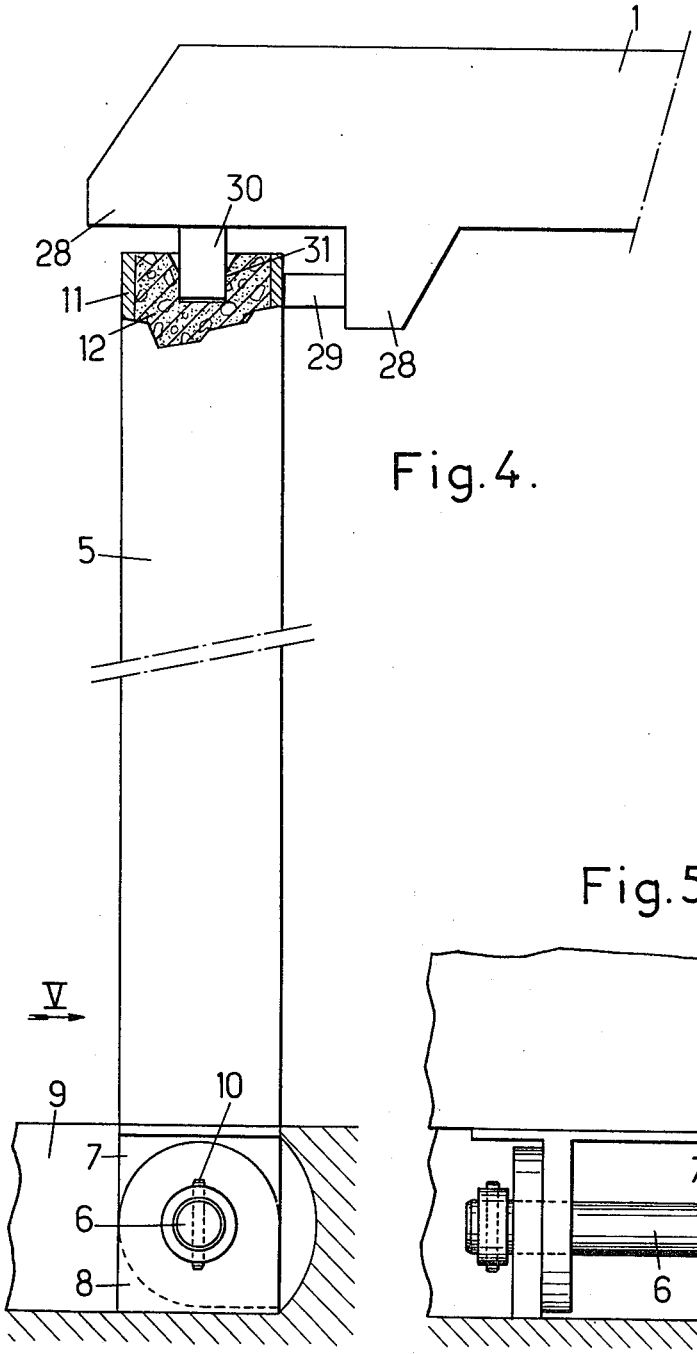
Fig. 4.
Fig. 5.
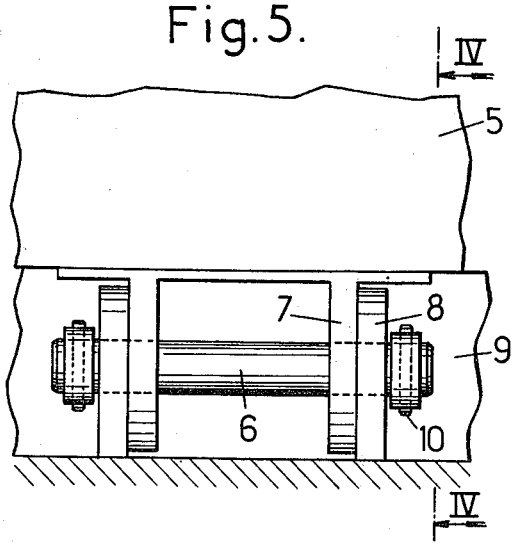

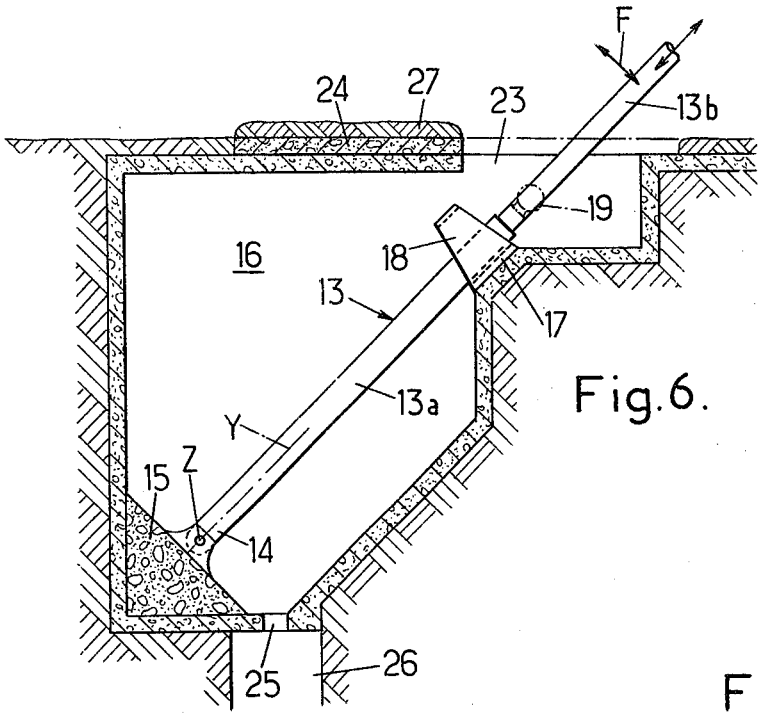
Fig.6.
Fig.8.
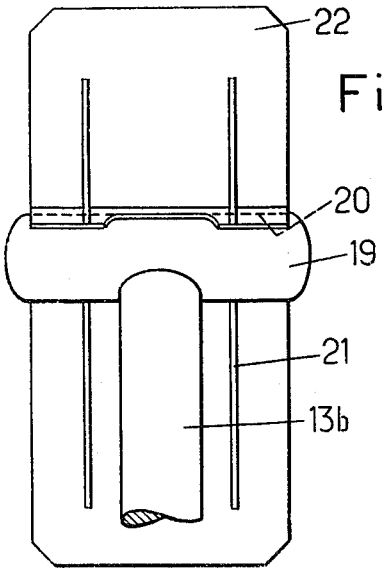
Fig.7.
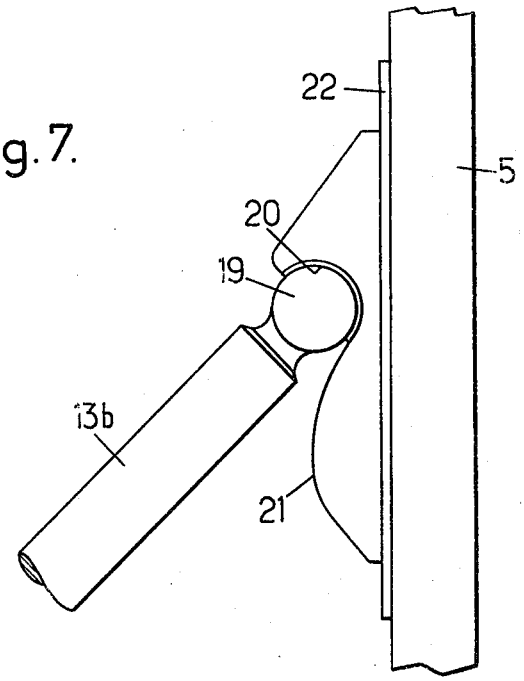

SWINGING DOORS FOR SHELTERS AND TO SHELTERS EQUIPPED WITH SUCH DOORS

The invention relates to swinging doors for closing off underground shelters intended to contain large-size aircraft for both protecting them against bombs, explosions, blasts and other external aggressions and liberating them simply, reliably and rapidly.

It also relates to the control means for said doors as well as shelters equipped with such doors.

Its aim is, more especially, to make the doors in question such that they afford an efficient protection for the shelters to which they are fitted in their closed position, that they are easy and safe to operate and that their operating members are themselves hidden and protected from external aggressions when they are closed.

The doors in question are essentially characterized in accordance with the invention in that they comprise a thick panel, itself formed preferably by metal plating filled with concrete, mounted for swinging about a lower horizontal axis X and associated with external operating jacks whose axes are inclined with respect to the horizontal while being mounted for slight pivoting about lower fixed axes parallel to the axis X, said jacks being, in their retracted condition, retracted into closed pits and presenting, in their extended condition, heads projecting outside said pits and arranged so as to bear in the manner of trunnions with axes parallel to the axis X against complementary bearing surfaces provided on the outer face of the door.

In preferred embodiments, recourse is had furthermore to one and/or the other of the following arrangements:

- the general shape of the panel is semi-elliptical,
- the angular movements of each jack about its lower fixed axis are limited in the lower position by a lateral fixed stop,
- these angular movements are guided by the vertical cheeks of a fixed ring,
- there is provided in the door casing, of the shelter, inside which the door is housed during closure thereof, resilient means adapted to be set or cocked by said closure and then to initiate subsequent reopening of the door,
- safety locking means are provided for the door in its closed position comprising bolts slidably mounted in the door casing of the shelter inside which the door is housed during said closure thereof, which bolts are adapted to coact with complementary keepers hollowed out in the upper edge of the door and the means for controlling the sliding of said bolts are combined with those for controlling the extending of the external jacks.

The invention comprises, apart from these principal arrangements, certain other arrangements which are preferably used at the same time and which will be more explicitly discussed hereafter.

In what follows a preferred embodiment of the invention will be described with reference to the accompanying drawings in a way which is of course in no wise limiting.

FIGS. 1, 2 and 3 of these drawings show respectively in vertical section along I—I of FIG. 2, in horizontal section along II—II of FIG. 1 and in vertical section along III—III of FIG. 1, an underground shelter for large-size aircraft equipped with a swinging door in accordance with the invention.

FIGS. 4 and 5 show details of this door on a larger scale, respectively in vertical views along IV—IV of FIG. 5 and along the arrow V of FIG. 4.

FIG. 6 shows an external pit fitted with its jack for controlling the swinging of the door, also in accordance with the invention.

FIGS. 7 and 8 show the projecting head of such a jack, mounted in swiveling abutment against the door.

Figure 3:
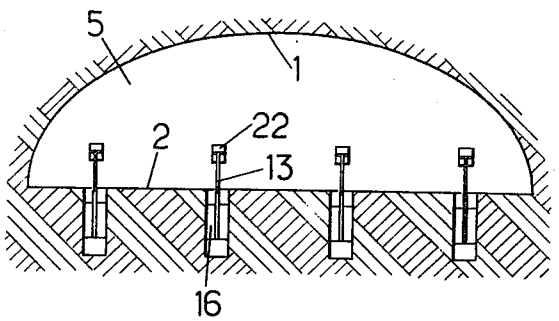

The underground shelter considered here is not very visible from outside and presents a great resistance to bombardments and other external aggressions.

It comprises a cylindrical vault 1 semi-elliptical in section made from reinforced concrete covering a rectangular area 2.

The dimensions of the tunnel defined by this vault 1 are relatively large, the height of said vault in particular possibly exceeding 10 meters and the sides of the rectangular area possibly exceeding 30 and even 40 meters.

One of the ends of said tunnel is closed by a concrete bottom 3 which may also be curved turning its concavity towards the inside of the shelter, which confers a great resistance thereon.

The other end of said tunnel forms an opening communicating with an access ramp 4 whose slope is calculated so that the aircraft to be sheltered may itself climb up this ramp when leaving the shelter.

It is this opening which is closable by means of a vertical door 5 mounted for swinging about a lower horizontal axis X.

This door is swingably mounted more especially by means of a plurality of shaft sections 6 (FIGS. 4 and 5) joiningly mounted both in double vertical lugs 7 extending the lower part of the door and in double vertical brackets embedded in the floor of the shelter, or more exactly in a cavity 9 hollowed out in the ramp and adapted to jointingly receive the door when lying flat in its open position, the axial movements of said shaft sections 6 being prevented by cottering 10.

The door 5 properly speaking is in the form of a thick panel having a semi-elliptical contour formed by a metal plating or apron 11 filled with concrete 12 or any other appropriate material such as a fireproof material or a trellis made from metal sections.

Door operation is provided by means of a plurality of hydraulic double-acting jacks 13, disposed outside the door and spread out along the base thereof.

Each of these jacks 13 presents the following features:

- it is formed from a lower sleeve 13*a* (FIG. 6) and from an upper rod 13*b* adapted to slide telescopically in this sleeve,
- its axis Y is constantly inclined with respect to the horizontal, particularly at an angle between 30° and 60°, this angle being shown equal to 45° in the drawing,
- the foot 14 of its sleeve 13*a* rests on a rigid base 15 provided at the bottom of a concrete pit 16 adapted to completely receive the jack in its retracted condition,
- the foot 14 is mounted on base 15 so that the jack may slightly rock about a pin Z connected to the base and parallel to axis X, during swinging of the door; the slight rocking movements in question of jack 13 about pin Z are limited in the lower part by the lateral abutment of sleeve 13*a* against a fixed bearing surface 17 provided in pit 16; these rocking movements are guided laterally by the vertical cheeks of an elongated ring 18 extending bearing surface 17 upwardly, the head of rod 13*b* is in the form of a T both the horizontal arms 19 of which (FIGS. 7 and 8) form trunnions cylindrical in revolution adapted to bear in complementary semi-bearings 20 provided on the door itself.

The semi-bearings 20 are themselves adjacent guide-tracks 21 for arms 19, the assembly of these semi-bearings and tracks being formed by means of gusset plates and metal plates integral with a distribution base 22 itself secured to the outer face of door 5.

The pit 16, hollowed out in the bottom of cavity 9 receiving the open door 15, communicates with this bottom through an upper trap 23 provided in the vicinity of the axis Y of the corresponding jack 13 so as to allow the extended rod 13*b* of this jack to pass therethrough.

This trap 23 is closable by means of a horizontal protection slab 24 made from reinforced concrete and mounted so as to be able to slide or roll horizontally.

To prevent the slabs 24 from projecting upwardly from the bottom of cavity 9 when they are in their open position and when the door rests on said bottom—which would require the provision of special blind cavities in this door to accommodate these slabs—the rolling or sliding tracks of said slabs are recessed in channels (not shown) hollowed out in this bottom.

According to a variation, the slabs 24 in question may be provided retractable inside pits 16 or other housings when they are in their open position. The movements of slabs 24 may themselves be controlled by means of double-acting jacks.

At the bottom of each pit 16 there is provided an opening 25 for draining rainwater, communicating with a sump 26.

The slabs 24 as well as the bottom of cavity 9 are advantageously coated with a camouflaging product 27 corresponding to the environment, a product such as natural grass covering a thin layer of arable earth or such as artificial grass.

The casing 28 for door 5—i.e. the end arch of vault 1 adapted to frame this door in its vertical closed position—comprises:

on the one hand, springs 29 adapted to be compressed horizontally by the door at the end of each of its closing movements and therefore to initiate by their expansion each subsequent reopening of the door, these springs being able to be replaced and/or completed by hydraulic double-acting damping devices, and, on the other hand, safety bolts 30 adapted to slide vertically and to cooperate with bell-mouthed keepers 31 provided in the upper edge of the door.

The control of bolts 30 is advantageously provided hydraulically like that of jacks 13 from the same sequential programming control unit.

Figure 1:
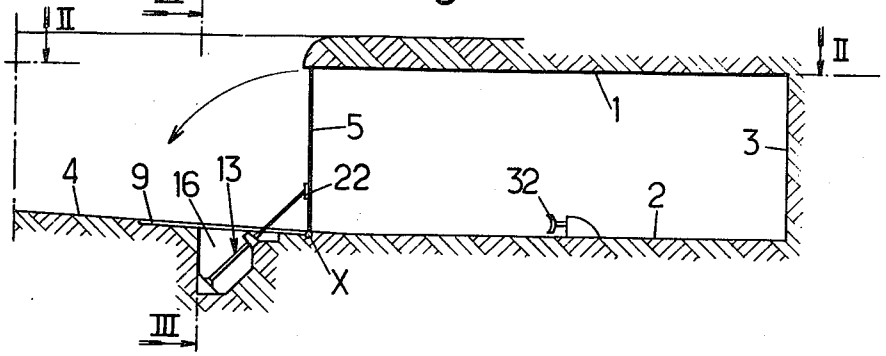
Figure 2:
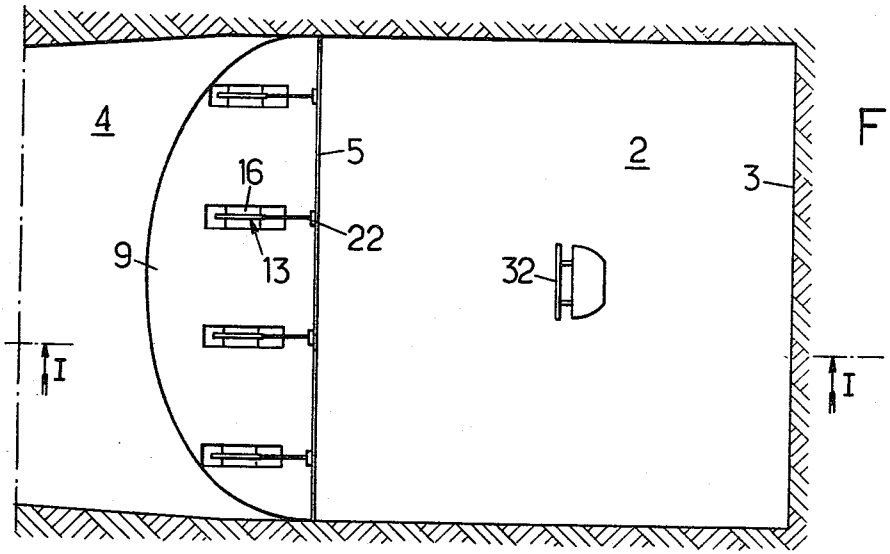

There can be further seen in FIGS. 1 and 2 a stop 32 adapted to cooperate with the landing-gear of the aircraft to be sheltered so as to limit penetration thereof into the shelter.

The operation of the assembly is the following.

In the closed position of the door, bolts 30 are engaged in keepers 31 (FIG. 1), the springs and/or damping devices 29 are compressed, the jacks 13 are retracted in their retracted position (shown with a broken line in FIG. 6) inside pits 16, whose traps 23 are closed by the slabs 24.

These jacks 13 are then screened, not only from inclement weather, but also from being seen from outside and from blasts, explosions and other similar aggressions.

To open the door, the following succession of operations is carried out:

opening of traps 23 by backing off slabs 24, simultaneous extension of all jacks 13 by extending their rods 13*b* in the direction of axes Y until their heads 19 contact first of all the guide-tracks 21 then, after sliding along these tracks, the semi-bearings 20, release of bolts 30 from keepers 31, expansion of the springs and/or damping devices 29, which initiates outward swinging of door 5, swinging of said door, which is held by the jacks whose rods 13*b* retract progressively into their sleeves 13*a*.

During this swinging movement, each jack undergoes a slight angular rocking about the corresponding lower pin Z in the direction of arrows F (FIG. 6) because the path of each head 19 is not linear, but describes an arc of a circle about axis X.

At the end of travel, door 5 is laid flat on the bottom of cavity 9.

If need be, in this flat position, it may rest on said bottom at the level of a few receiving supports specially provided for cooperating with opposite bearing surfaces on the door.

When the door is thus open and laid flat in its cavity 9, it covers all the pits 16 and its upper face is in the extension of the surfaces of the ground of area 2 and of ramp 4.

The aircraft contained in the shelter may then leave this latter by rolling over said upper face of the flat-lying door before reaching ramp 4, rolling tracks being provided on this face and on this ramp for receiving the landing-gear of the aircraft.

This latter may leave under its own means, appropriate chimneys equipped with adequate traps being provided in the shelter for discharging the exhaust gases.

To close the door again afterwards, particularly after the aircraft has returned to the shelter, which is achieved more especially by backing in with the help of a cable winch (not shown) until the landing-gear of said aircraft abuts against stop 32, the reverse of the above succession of operations is carried out, namely:

extension of jacks 13, which causes the door to swing up again about its axis X because of the thrust of heads 19 thereagainst with again a slight rocking of said jacks about their pins Z in the direction of arrows F, compression of the springs and/or the damping devices 29 when the door reaches a substantially vertical position, downward movement of bolts 30 into keepers 31, withdrawal of rods 13*b* of the jacks by retraction into their sleeves 13*a* (position shown with a broken line in FIG. 6), closure of traps 23 by means of slabs 24.

The succession of these different operations, which may be effected very rapidly, may be carried out in a more or less automatic way at will.

In particular, the locking of the door may be automatically initiated after sufficient cocking of the springs and/or damping devices 29.

Similarly, unlocking thereof may be automatically controlled when the extension of rods 13*b* exceeds a predetermined threshold.

Following which, and whatever the embodiment adopted, a swinging door is provided for an underground shelter whose construction and operation follow sufficiently from what has gone before.

The assembly of this shelter and this door presents numerous advantages with respect to those known heretofore, in particular as regards the efficiency of the protection which it provides for the sheltered aircraft when the door is in its closed position, the small chance that it offers of being seen from the air, as well as the simplicity, rapidity and reliability of the closing and opening movements of the door.

As is evident, and as it follows moreover already from what has gone before, the invention is in no wise limited to those of its modes of application and embodiments which have been more especially considered; it embraces, on the contrary, all variations thereof, particularly: those where the shelter considered is located not on a horizontal or substantially horizontal piece of ground with which it communicates by means of an access ramp 4, but at the base of a mountain, hillock or similar; those where the heads of the jacks are not in the form of a T, but in the form of an upturned U whose base forms the cylindrical trunnion having an axis parallel to axis X, mounted between the two arms of a fork joint; and those where the swiveling mounting of each jack head on the door is ensured by providing on the door the cylindrical trunnion with axis parallel to axis X and on the jack head the semi-bearing surface adapted to accommodate this trunnion.

I claim:

1. A swinging door for an underground aircraft shelter, characterized in the said door comprises a thick panel mounted for swinging about a lower horizontal axis and associated with external operating jacks whose axes are inclined with respect to the horizontal while being mounted so as to be pivotable slightly about lower fixed pins parallel to said horizontal axis, said jacks, in their retracted position, being retracted into closed pits and arranged so as to bear in the manner of trunnions having axes parallel to said horizontal axis against complementary bearing surfaces provided on the external face of the panel.

2. The door as claimed in claim 1, characterized in that the slope of the axes of the jacks is between 30° and 60°.

3. The door as claimed in any one of claims 1 or 2, characterized in that the panel is formed by a metal apron filled with concrete.

4. The door as claimed in claim 1, characterized in that the panel has a general semi-elliptical shape.

5. The dooor as claimed in claim 1, characterized in that the angular movements of each jack about its associated fixed lower pin are limited in the lower part by a fixed lateral stop.

6. The door as claimed in claim 5, characterized in that said angular movements are guided by the parallel vertical cheeks of a fixed ring.

7. The door as claimed in claim 1 further comprising a casing which comprises resilient means adapted to be cocked or set by the closing movements of the door and then to initiate the subsequent reopening movements thereof.

8. An underground shelter equipped with a door as claimed in claim 1, communicating with the outside by means of an access ramp, characterized in that this ramp has hollowed out therein a cavity for receiving the door when lying flat, the pits of the jacks opening into the bottom of this cavity.

9. The underground shelter as claimed in claim 8, characterized in that slabs for closing the pits into which the external jacks are retracted are arranged and mounted so that in their open position they remain recessed in the bottom of the cavity for receiving the door.

* * * * *